US005944431A

United States Patent [19]

Becker et al.

[11] Patent Number: 5,944,431

[45] Date of Patent: Aug. 31, 1999

[54] SHEET SENSOR DEVICE WITH LIGHT CURTAIN

[75] Inventors: Willi Becker, Bammental; Karl-Heinz Helmstaedter, Sinsheim; Andreas Henn, Neckargemuend; Tobias Mueller, Hirschberg; Juergen Rautert; Andreas Schulz, both of Heidelberg; Josef Wehle, Gaiberg, all of Germany

[73] Assignee: Heidelberger Druckmaschinen AG, Heidelberg, Germany

[21] Appl. No.: 09/031,419

[22] Filed: Feb. 26, 1998

[30] Foreign Application Priority Data

Feb. 26, 1997 [DE] Germany ..... 197 07 660

[51] Int. Cl.[6] ..... B41J 29/18

[52] U.S. Cl. ..... 400/708; 400/711

[58] Field of Search ..... 400/708, 711, 400/709, 706, 703

[56] References Cited

U.S. PATENT DOCUMENTS

| | | | |
|---|---|---|---|
| 4,906,170 | 3/1990 | Nelson et al. | 400/708 |
| 5,078,379 | 1/1992 | Leisner | 271/3.1 |
| 5,336,003 | 8/1994 | Nagashima et al. | 400/708 |
| 5,467,194 | 11/1995 | Pellinen | 356/429 |
| 5,547,299 | 8/1996 | Dusterhus et al. | 400/708 |
| 5,552,890 | 9/1996 | Nanna | 101/483 |
| 5,601,375 | 2/1997 | Sims et al. | 400/708 |

FOREIGN PATENT DOCUMENTS

| | | | |
|---|---|---|---|
| 21 56 506 | 11/1972 | Germany . | |
| 30 18 393 C2 | 2/1982 | Germany . | |
| 33 28 843 A1 | 6/1984 | Germany . | |
| 401047577 | 2/1989 | Japan | 400/703 |

*Primary Examiner*—Edgar Burr
*Assistant Examiner*—Anthony H. Nguyen
*Attorney, Agent, or Firm*—Kenyon & Kenyon

[57] ABSTRACT

A sheet sensor device for a sheet-fed printing press having a sheet-reversing arrangement, said sheet-reversing arrangement being comprised essentially of a storage drum, a reversing drum and gripper systems mounted on these drums, so that a sheet sensor device comprising a transmitter and a receiver is arranged in the sheet-reversing area formed between the storage drum and the reversing drum, and that the transmitter is arranged on the one side of the printing machine, and the receiver is arranged on the other side of the printing machine, outside of the sheet-travel area.

6 Claims, 2 Drawing Sheets

SHEET SENSOR DEVICE WITH LIGHT CURTAIN

FIELD OF THE INVENTION

The present invention relates to a sheet sensor device for a sheet-fed printing press with a reversing arrangement which has a gripper system for advancing individual sheets.

RELATED TECHNOLOGY

For sheet-fed printing presses with front face and back face printing, there are reversing arrangements which contain a storage drum for the temporary storage of sheets from a printing unit for face printing, as well as a reversing drum to feed a sheet, temporarily stored on the storage drum, in the reverse conveying direction, i.e. with the former trailing edge of the sheet in front, to a subsequent printing unit for reverse-side printing. The storage drum and reversing drum each contain a gripper system for retaining a sheet at its leading edge and trailing edge, respectively.

To monitor whether a sheet was transferred correctly in the reversing arrangement, in the related art there are various electropneumatic sheet sensors such as snifter pistons or query suction devices, or electro-optical sheet sensors such as reflection-light probes which sense the presence of the leading edge or trailing edge of a sheet at one or several locations in the reversing arrangement. If the sheet is not detected, printing is shut down.

All known sheet sensors have at least a few of the following disadvantages.

To function reliably, the sensor must be arranged relatively close to the sheet running past it. Since the sheet side printed in the face printing shows outwardly on the storage drum, there is the danger of fresh printing ink smearing on the sensor, which is all the greater, the more the sheet flutters. Not only the fresh print image is damaged by the smearing, but the sensor is soiled as well. That is why opto-electronic sensors, in particular, must be cleaned frequently. To prevent smearing, sheet-guiding plates with air support have been used. However, they increase the structural expenditure for the printing machine without completely eliminating the problem of the soiling of the sensor.

While electropneumatic sensors may be less prone to soil than electro-optical sensors, they are relatively complicated in mechanical terms. In addition, since the response characteristic of such sensors is a function of the printing speed and the type of stock, frequent adjustments are necessary.

Finally, frequently it is only possible to mount the known sensors in an unfavorable angular position, i.e. in a position in which an incorrect sheet transfer is recognized relatively late, so that the printing is shut down relatively late as well.

SUMMARY OF THE INVENTION

An object of the present invention is to create a sheet sensor device which is little prone to soil, whose mechanical construction is simple, and with which a misfed sheet can be recognized as early as possible.

The present invention therefore provides a sheet sensor device for a sheet-fed printing press, the sheet sensor device being designed in such a way that a sheet sensor, comprised of a transmitter (11) and a receiver (12), is arranged in the sheet-reversal area, and that the transmitter is arranged on the one side (BS) of the printing machine, and the receiver is arranged on the other side (AS) of the printing machine, outside of the sheet-travel area.

Because the transmitter and receiver are disposed outside of the sheet-travel area, a collision between the transmitter or receiver and a sheet can be ruled out. The use of a sensor light curtain according to the present invention has an advantageous effect, since this also allows sheets to be detected which are in different planes of the sheet-transfer area. The light curtain can be adjusted closer to or away from the reversing drum, which is useful for early sheet detection. This adjustment possibility through the light curtain is also enhanced since a plurality of ray paths are present, instead of just a single ray path which is aligned exactly with the axially parallel sheet recognition. An arriving sheet, sinking during the transfer from the storage drum to the reversing drum, can plunge or drop into the plurality of ray paths and thus be detected more reliably than if only one ray path were present.

By using self-calibrating sensors, the intervals between servicing and cleaning are lengthened, and a malfunction is indicated immediately. During each machine revolution a check test can be performed.

Given the joining of light-reflection barriers, the possibility of using the sheet sensor especially in poorly accessible areas is increased. Furthermore, the signal transfer from the sheet sensor to the computer is only necessary from one location.

BRIEF DESCRIPTION OF THE DRAWINGS

Further features and advantages of the present invention are evident from the following description of several exemplary embodiments in which.

In the figures, identical or functionally equivalent parts are designated everywhere with the same reference numerals.

DETAILED DESCRIPTION

Figure 1:
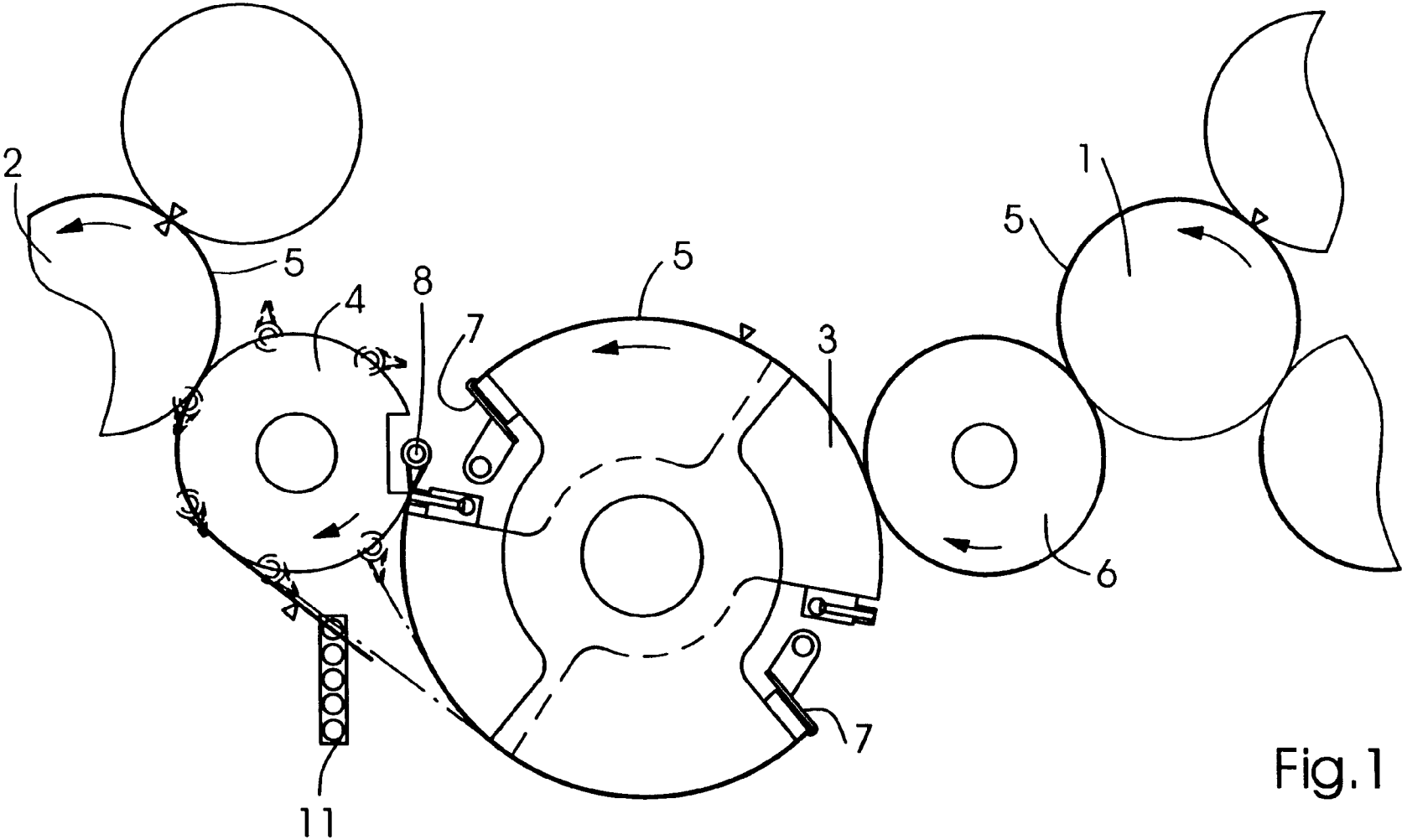
FIG. 1 shows a side view of a reversing arrangement in a sheet-fed printing press.

The reversing arrangement shown in FIG. 1 is part of a sheet-fed printing press having an impression cylinder 1 for face printing and an impression cylinder 2 for reverse-side printing. The reversing arrangement disposed between impression cylinder 1 for face printing and impression cylinder 2 for reverse-side printing comprises a storage drum 3 and a reversing drum 4 arranged adjacent to it. The diameter of storage drum 3 is roughly double that of impression cylinders 1,2 and reversing drum 4. The sheet-reversing area lies preferably between reversing drum 4 and storage drum 3 in the sheet-transport area.

Sheets 5 printed on impression cylinder 1 are conveyed in succession via an intermediate cylinder 6 onto storage drum 3, upon which the printed side of the sheet lies on the outside. While storage drum 3 turns, it retains the leading edge of sheet 5 using grippers 7. After the trailing edge of sheet 5 has arrived at reversing drum 4, said trailing edge is grasped by grippers 8 on reversing drum 4 and is pulled off of storage drum 3 by reversing drum 4 which rotates contrary to storage drum 3, the previous trailing edge of sheet 5 becoming its leading edge. From reversing drum 4, on which the printed side of sheet 5 likewise lies on the outside, sheet 5 is transferred to the printing unit having impression cylinder 2, on which the reverse-side printing is carried out.

The rotation directions of the individual drums and cylinders are marked in FIG. 1 with arrows, and the respective printed sheet sides are indicated with triangles. Sheets 5 in various intermediate phases of the reversal are indicated by dot-dash lines. Grippers 8 on reversing drum 4 are marked in FIG. 1 with dashed lines in various phases of the rotation of reversing drum 4.

Figure 2:
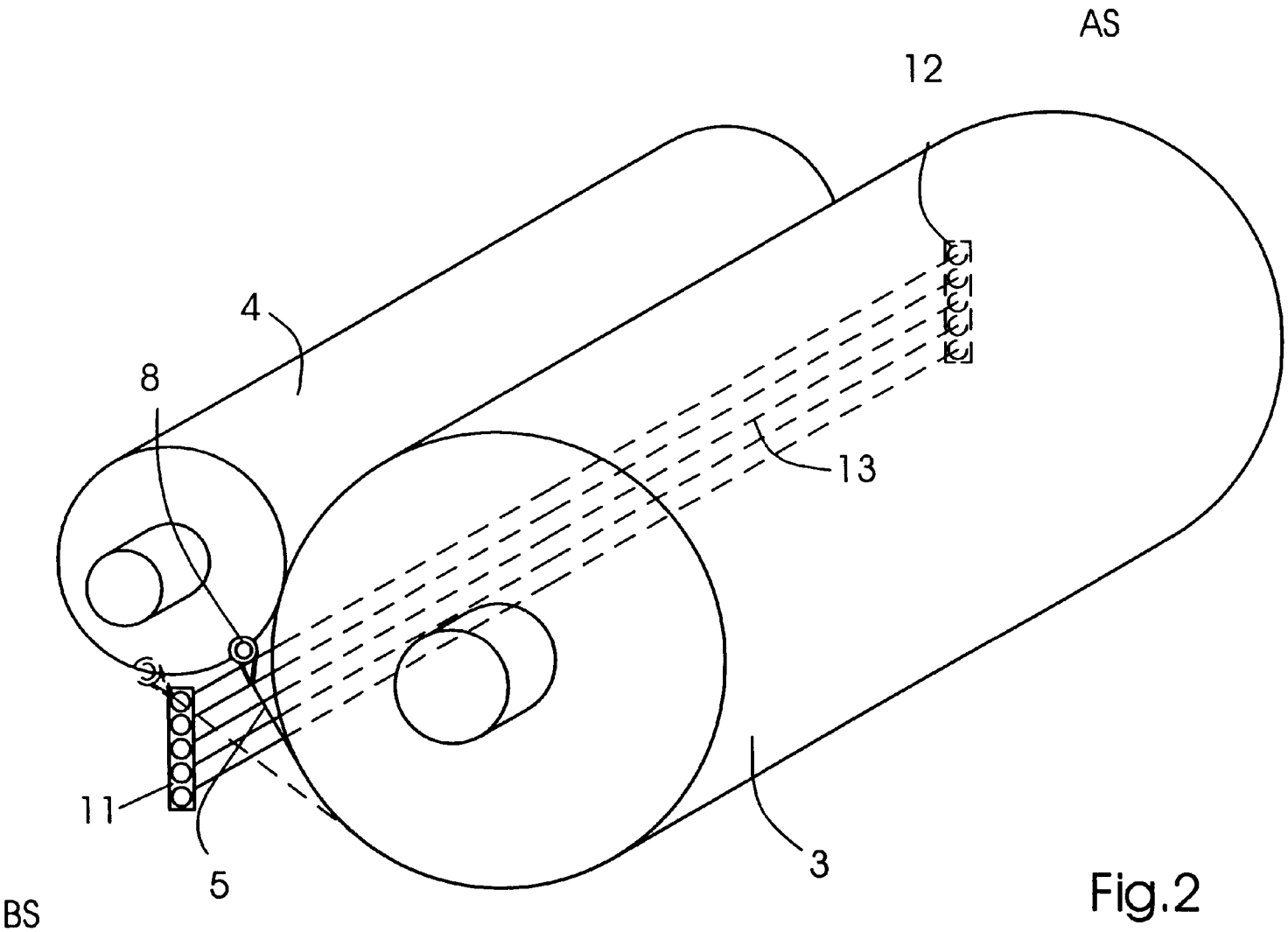
FIG. 2 shows a schematic perspective view of the reversing drum and the storage drum of the reversing arrangement shown in FIG. 1.

A sheet sensor for the reversing arrangement is now described with reference to FIG. 2 which is a schematic, perspective view at an angle from above of the reversing arrangement shown in FIG. 1. The sheet sensor 11, 12 forms a light curtain 13 and is arranged axially parallel to reversing drum 4 and storage drum 3. The sensor is comprised of a transmitter 11 and a receiver 12. Transmitter 11 has a plurality of light sources which correspond in each case with receiver 12. Due to this arrangement, the light curtain 13 results which is arranged essentially vertically. Preferably this light curtain 13 is arranged nearer in the area of reversing drum 4, however in such a way that the reversing-drum grippers are not detected as sheets. Transmitter 11 and receiver 12 of sheet sensor 11,12 are arranged outside of the transport area in which sheet 5 is located when it disengages from the cylinder and is transported to reversing drum 4. Therefore, contact of the sheet with sheet sensor 11, 12 is ruled out.

In a query position, in which the presence of the lateral edge of the fluttering sheet is queried in the region of the leading edge (i.e. the former trailing edge of the sheet), the leading edge of the sheet retained by grippers 8 travels through light curtain 13 formed between transmitter 11 and receiver 12. If sheet sensor 11, 12 detects a leading edge at the correct point of time, the sheet to be printed is defined as a good sheet and is further transported. If no sheet, or rather no leading edge is detected by sheet sensor 11,12, the printing operation is stopped.

The moment when the sheet recognition is supposed to take place can be adjusted by shifting sheet sensor 11,12 closer to reversing drum 4 or closer to storage drum 3. A sheet recognition at an earlier point of time increases the remaining reaction time for shutting down the printing.

In the description and in the figures, a reversing arrangement is shown as the exemplary embodiment having a storage drum 3 which is twice as large. However, the present invention is not restricted to this specific embodiment. Rather, the present invention is applicable in any type of sheet reversing.

The sensors 11 and 12 can be connected to a microprocessor, which can also control the printing press speed and on/off function.

What is claimed is:

1. A sheet sensor device for a sheet-fed printing press having a first side, a second side, a sheet-travel area and a sheet-reversing area, the sheet sensor device comprising:

a sheet sensor located at the sheet-reversing area, the sheet sensor including a first transmitter and a second transmitter located at the first side of the printing press and a first receiver and a second receiver located at the second side of the printing press, the first transmitter, the second transmitter, the first receiver and the second receiver being arranged outside of the sheet-travel area so as to form a light curtain perpendicular to a sheet-travel direction.

2. The sheet sensor device as recited in claim 1 wherein the sheet sensor forms a light-reflection barrier.

3. The sheet sensor device as recited in claim 1 wherein the sheet sensor is movably located between a storage drum and a reversing drum of the sheet-fed printing press.

4. The sheet sensor device as recited in claim 1 wherein the printing press includes a reversing drum having an axis of rotation, the first transmitter and second transmitter transmitting radiation parallel to the axis of rotation.

5. A sheet sensor device for a sheet-fed printing press having a first side, a second side, a sheet-travel area and a sheet-reversing area, the sheet sensor device comprising:

a sheet sensor located at the sheet-reversing area, the sheet sensor including a first transmitter, a second transmitter and a third transmitter located at the first side of the printing press and a first receiver, a second receiver and a third receiver located at the second side of the printing press, the first, second and third transmitters and the first, second and third receivers being arranged outside of the sheet-travel area so as to form a light curtain perpendicular to a sheet-travel direction.

6. A sheet sensor device for a sheet-fed printing press having a first side, a second side, a sheet-travel area and a sheet-reversing area, the sheet sensor device comprising:

a sheet sensor located at the sheet-reversing area, the sheet sensor including a first transmitter and a second transmitter located at the first side of the printing press and a first receiver and a second receiver located at the second side of the printing press, the first transmitter, the second transmitter, the first receiver and the second receiver being arranged outside of the sheet-travel area, the first receiver for receiving a first ray from the first transmitter and the second receiver for receiving a second ray from the second receiver, the first and second rays being parallel so as to form a light curtain perpendicular to a sheet-travel direction.

* * * * *